US006250182B1

(12) United States Patent
Veitinger

(10) Patent No.: US 6,250,182 B1
(45) Date of Patent: Jun. 26, 2001

(54) SOCKET ASSEMBLY FOR ULTRASOUND-CONTROLLED SCREWING DEVICE

(75) Inventor: Heinz Veitinger, Murrhardt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/466,334

(22) Filed: Dec. 17, 1999

(30) Foreign Application Priority Data

Dec. 21, 1998 (DE) ..... 198 59 019

(51) Int. Cl.[7] ..... B25B 13/00
(52) U.S. Cl. ..... 81/52; 81/121.1
(58) Field of Search ..... 81/52, 54, 429, 81/470, 121.1

(56) References Cited

U.S. PATENT DOCUMENTS 5,699,703 * 12/1997 Habele ..... 81/57.38
5,974,919 * 11/1999 Habele ..... 81/470

FOREIGN PATENT DOCUMENTS 42 31 429 C1 3/1994 (DE) .
44 31 675 A1 3/1996 (DE) .
2684585 A1 * 6/1993 (FR) ..... 81/463

* cited by examiner

*Primary Examiner*—James G. Smith
*Assistant Examiner*—David B. Thomas
(74) *Attorney, Agent, or Firm*—Michael J. Striker

(57) ABSTRACT

A socket assembly for an ultrasound-controlled screwing device has a coupling for rotary connection of a screw connection with a screw spindle, an electrical conducting element for electrically conducting connection between the screw connection and the socket, and the electrical contacting element having an electrical conductor which is held in a springy way against the socket.

8 Claims, 1 Drawing Sheet

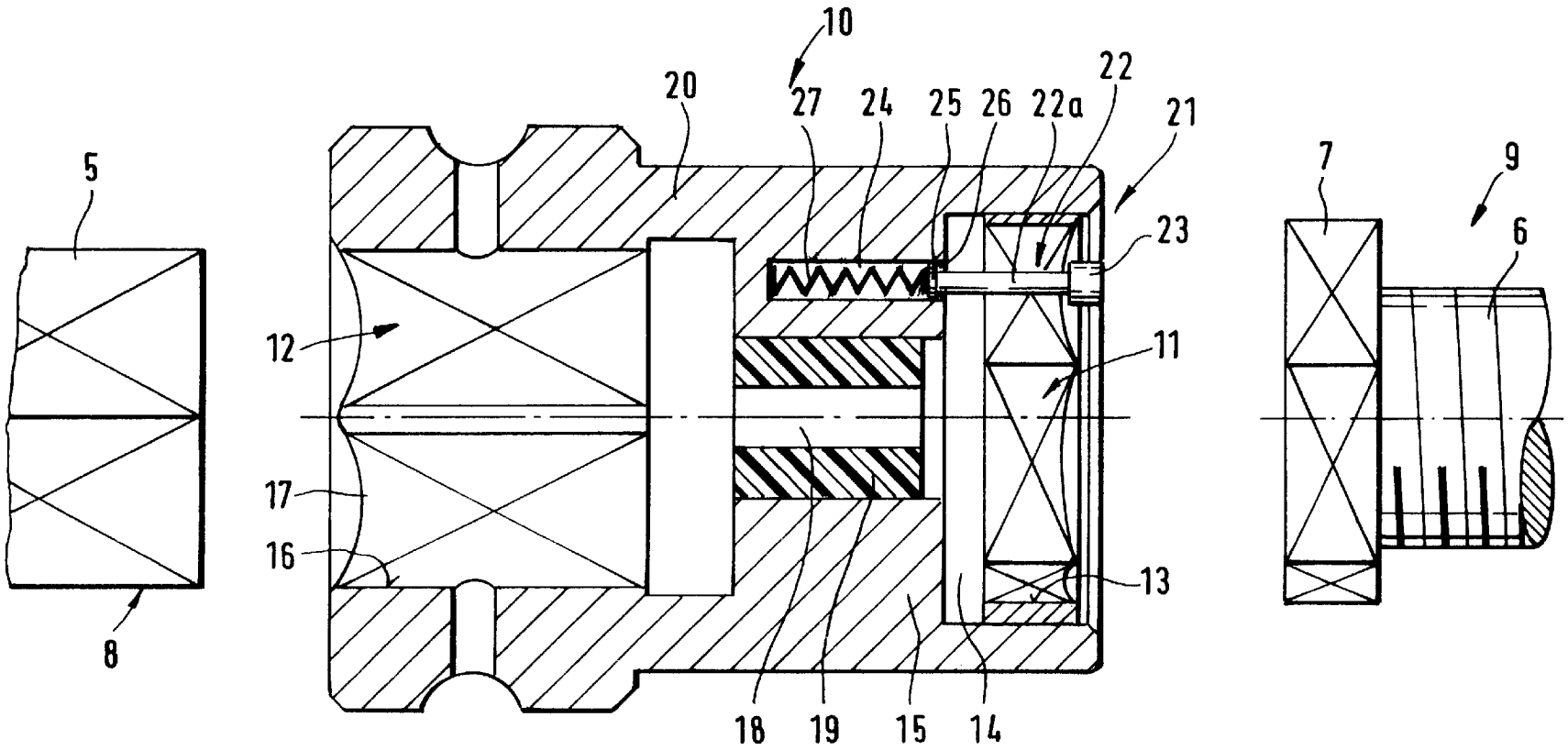
9
6
7
21
23
11
13
22
22a
26
25
24
27
10
14
15
19
18
20
12
17
16
5
8

SOCKET ASSEMBLY FOR ULTRASOUND-CONTROLLED SCREWING DEVICE

BACKGROUND OF THE INVENTION

The present invention relates to a socket assembly for an ultrasound-controlled screwing device.

Such a socket assembly is disclosed for example in the German patent document D-A 42 31 429. It has a coupling means for a rotary connection between a screw connection and a screw spindle of a screwing device. The socket assembly serves additionally for producing an electrical connection between the screw connections and the screwing device, so that the screwdriver due to its electrical conductivity provides a ground terminal of the screwing device. The voltage supply to, an ultrasound resonator arranged on the screw connection is performed through a contact pin engaging the socket assembly. A presumption for an error-free contacting of the ultrasound resonator is an interference-free ground contacting, which in the known screwdriver is not always provided in particular during the plugging on the screw connection.

For eliminating the above mentioned problem, it is proposed in the German patent document DE-A 44 31 675, to arrange on the screw spindle a ground conductor parallel to the contact pin, which similarly to the contact pin engages the socket assembly and contact the screw connection. The additional ground conductor eliminates the contact interferences, however, it makes necessary the provision of its own screw spindle. With the screw spindles having only one contact pin, the problem of electrical ground contacting further is caused.

SUMMARY OF THE INVENTION

Accordingly, it is an object of the present invention to provide a socket assembly which avoids the disadvantages of the prior art.

In keeping with these objects and with others which will become apparent hereinafter, one feature resides, briefly stated, in a socket assembly, in which the contacting means have an electrical conductor which is held in a springy manner on the socket.

When the socket assembly is designed in accordance with the present invention, an interference-free electrical mass contacting between the screw connection and the screwing device is guaranteed also during the placement of the socket assembly on the screw connection, without requiring simultaneously a specifically designed screw spindle.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view showing a longitudinal section of a socket assembly formed in accordance with the present invention.

DESCRIPTION OF PREFERRED EMBODIMENTS

A socket assembly is identified in the drawing with reference numeral 10. It is formed substantially sleeve-shaped as a tool nut. At its both end sides, it is provided with coupling means 11 and 12 for a rotary connection between a screw connection identified with reference numeral 9 as a whole and a screw spindle 8 of a screwing device. Only a screw 6 with a screw head 7 is shown as a part of the screw connection 9. Both the screw connection 9 and the screw spindle 8 are designed as in the prior art, for example in the German patent document DE-A 42 31 429. Therefore, the very detailed description is dispensed with.

A first coupling element 11 serves for a rotary connection of the screw 6 with the socket assembly 10. The first coupling element 11 is formed an inner polygonal formation 13. The inner polygonal formation 13 forms a receptacle 14 for the screw head 7 formed as an outer polygonal formation. The receptacle 14 is limited axially by an inwardly projecting collar 15.

A second coupling element 12 serves for the rotary connection of the socket assembly 10 with the screw spindle 8. The second coupling element 12 is formed also as an inner polygonal formation 16, which has an opening 17 for a corresponding outer polygonal formation 5 on the screw spindle 8. The receptacle 14 and the opening 17 are connected with one another by a passage 18. The passage 18 serves for passing of a not shown contact pin, when the socket assembly 10 is placed on the screw spindle 8, analogously to the structure disclosed in the German patent document DE-A 44 31 675.

The socket assembly 10 has a tool base body 20 which is composed of an electrically conductive material. The passage 18 is electrically insulated from the conductive material of the tool base body 20 by a sleeve-shaped insulating body 19. A conductor 22 which is formed as a contact pin 22*a* is located inside the receptacle 14. It serves for ground contacting of the screw connection 9. The contact pin 22*a* for this purpose is composed of an electrically conductive material, as the tool base body 20. It carries a contact head 23 at its end facing the socket 10. The contact pin 22*a* is axially displaceably received in an opening 24 in the collar 15 of the tool base body 20. It is guided through ring collar 25. A spring ring 26 at the end of the opening 24 prevents falling out of the contact pin 22*a* from the opening 24. A spring 27 tensions the contact pin 22*a* in direction toward the screw connection 9.

When the socket assembly 10 is placed on the screw connection 9, the contact head 23 contacts the screw head 7. An electrical connection with the tool base body 20 is produced through the ring collar 25 or the spring 27. During insertion of the screw head 7 into the receptacle 14, the contact pin 22*a* is displaced back axially against the force of the spring 27. The contact pin 22*a* always abuts against the screw head 7. Instead of the springy contact pin, also other conductors are possible which during placement of the socket 10 on the screw connection 9 serve for a good electrical contact, and during insertion of the screw head 7 deviate into the receptacle 14. For example a flat spring held on the socket 10 inside the receptacle 14 can be provided.

The contacting of the screw spindle 8 is performed directly from the tool base body on the outer corner formation 8, when it is inserted in the opening 17. An additional contacting can be also provided through a conductor between the screw spindle 8 and the socket 10.

It will be understood that each of the elements described above, or two or more together, may also find a useful application in other types of constructions differing from the types described above.

While the invention has been illustrated and described as embodied in socket assembly for ultrasound-controlled screwing device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A socket assembly for an ultrasound-controlled screwing device, comprising a socket; provided with a coupling for rotary connection of a screw connection with a screw spindle, electrical conducting means for electrically conducting connection between said screw connection and the socket, the electrically contacting means having an electrical conductor which is held in a springy way against the socket.

2. A socket assembly as defined in claim 1, wherein said electrical conductor is arranged in a receptacle which is formed as an polygonal formation for a screw head of the screw connection.

3. A socket assembly as defined in claim 2, wherein said conductor is a contact pin which is longitudinally displaceably received in an axial extending opening in a tool base body of the socket, and further comprising a spring which tensions said contact pin in direction toward the screw connection.

4. A socket assembly as defined in claim 3, wherein said opening is provided in a collar which axially limits said receptacle.

5. A socket assembly as defined in claim 3, wherein said contact pin has a contact head provided at its end facing the screw connection.

6. A socket assembly as defined in claim 3, wherein said contact pin is provided with a ring collar at its end facing said opening.

7. A socket assembly as defined in claim 6; and further comprising a safety ring which non releasably holds said ring collar in said opening.

8. A socket assembly as defined in claim 1, wherein said socket is formed sleeve-shaped as a tool nut, and has two end sides provided with coupling means formed each as an inner polygonal formation.

* * * * *